US006086026A

United States Patent [19]

Pearce

[11] Patent Number: 6,086,026

[45] Date of Patent: Jul. 11, 2000

[54] BOW HOLDER

[76] Inventor: Donald R. Pearce, 4800 N. Happe Rd., Evansville, Ind. 47720

[21] Appl. No.: 09/157,867

[22] Filed: Sep. 21, 1998

Related U.S. Application Data

[60] Provisional application No. 60/061,160, Oct. 6, 1997.

[51] Int. Cl.[7] ..... F16M 11/00

[52] U.S. Cl. ..... 248/127; 211/13.1; 248/300

[58] Field of Search ..... 248/127, 300, 248/309; 211/85.7, 13.1, 70.6

[56] References Cited

U.S. PATENT DOCUMENTS

| | | | |
|---|---|---|---|
| 3,128,979 | 4/1964 | Damelio | 211/60.1 |
| 3,858,725 | 1/1975 | Pietrack et al. | 211/13 |
| 4,583,647 | 4/1986 | Schinzing | 211/60.1 |
| 4,864,787 | 9/1989 | Bukowski | 52/284 |
| 4,957,251 | 9/1990 | Hubbard | 248/68.1 |
| 4,993,670 | 2/1991 | Tesar | 48/68.1 |
| 5,039,052 | 8/1991 | Carafice | 248/309.1 |
| 5,386,915 | 2/1995 | Sirhan | 211/70.6 |
| 5,615,782 | 4/1997 | Choe | 211/70.6 |
| 5,626,244 | 5/1997 | Mesna et al. | 211/60.1 |
| 5,632,386 | 5/1997 | Gabhart | 211/85.7 |

*Primary Examiner*—Leslie A. Braun
*Assistant Examiner*—Kimberly Wood
*Attorney, Agent, or Firm*—George H. Morgan

[57] ABSTRACT

The bow holder comprises a plate, a clamp bar, and a bolt for clamping the plate and the clamp bar to a treestand. The plate has a cross-shaped aperture for holding a bow, oblong apertures for reducing vibrations that result from result from dragging a bow string against the plate, and a thermoplastic vinyl coating. An alternate embodiment has multiple cross apertures for storing or displaying multiple bows.

2 Claims, 4 Drawing Sheets

BOW HOLDER

CROSS REFERENCE TO RELATED APPLICATIONS

This Appl. claims benefit of provisional appln. 60/061, 160 Oct. 6, 1997.

STATEMENT AS TO RIGHTS TO INVENTIONS MADE UNDER FEDERALLY SPONSORED RESEARCH AND DEVELOPMENT

Not applicable

BACKGROUND OF THE INVENTION

1. Field of the Invention

The present invention is a device for holding an archer's bow. One embodiment is usable as a part of a tree stand such as hunters use in hunting deer. Another embodiment is useful as part of a display such as merchants would find useful.

2. Background Information

Existing bow holders and hangers such as archers use to hang bows while hunting deer from a tree stand have shortcomings. Bow hangers exist that are bulkier and heavier which is undesirable because hunters carry their hangers to and from their stand. Bow holders exist but they do not hold the bow as well as the present invention. To remove a bow from an existing bow holder or hanger is relatively complicated. Existing bow holders and hangers often fasten to or hang from a tree, which can be detrimental to the tree. Also, many bow holders and hangers are holding or hanging a bow in such a way that excessive movement is required by a hunter to reach for and then remove the bow. Deer are alerted by movement, so minimizing movement to reach a bow is desirable. Also, many existing bow holders and hangers install on a tree stand in locations inconvenient for the hunter. Some existing bow holders require altering the tree stand for mounting the bow holder. Also, some bow holders require attachments mounted on the bow itself for the bow holder to secure the bow to a stand.

As will be seen in the subsequent description, the preferred embodiment of the present invention overcomes these and other shortcomings of exisitng bow holders and hangers.

SUMMARY OF THE INVENTION

The present invention is a holder for bows such as a hunter would use to hold a bow while hunting deer from a tree stand. It comprises a plate, a powder coated clamp bar, and a means of attachment to a treestand. The plate comprises at least one cross aperture for holding a bow, oblong apertures, a mounting aperture, and a vinyl coating. The oblong apertures serve both to save weight and also to minimize vibrations resulting from a bow scraping against the vinyl coating of the plate while a hunter is removing a bow. Minimizing vibrations reduces noise. An alternate embodiment of the present invention has multiple cross apertures for holding multiple bows, such as would be desirable for storing or displaying multiple bows.

DESCRIPTION OF THE PREFERRED EMBODIMENTS

Figure 1:
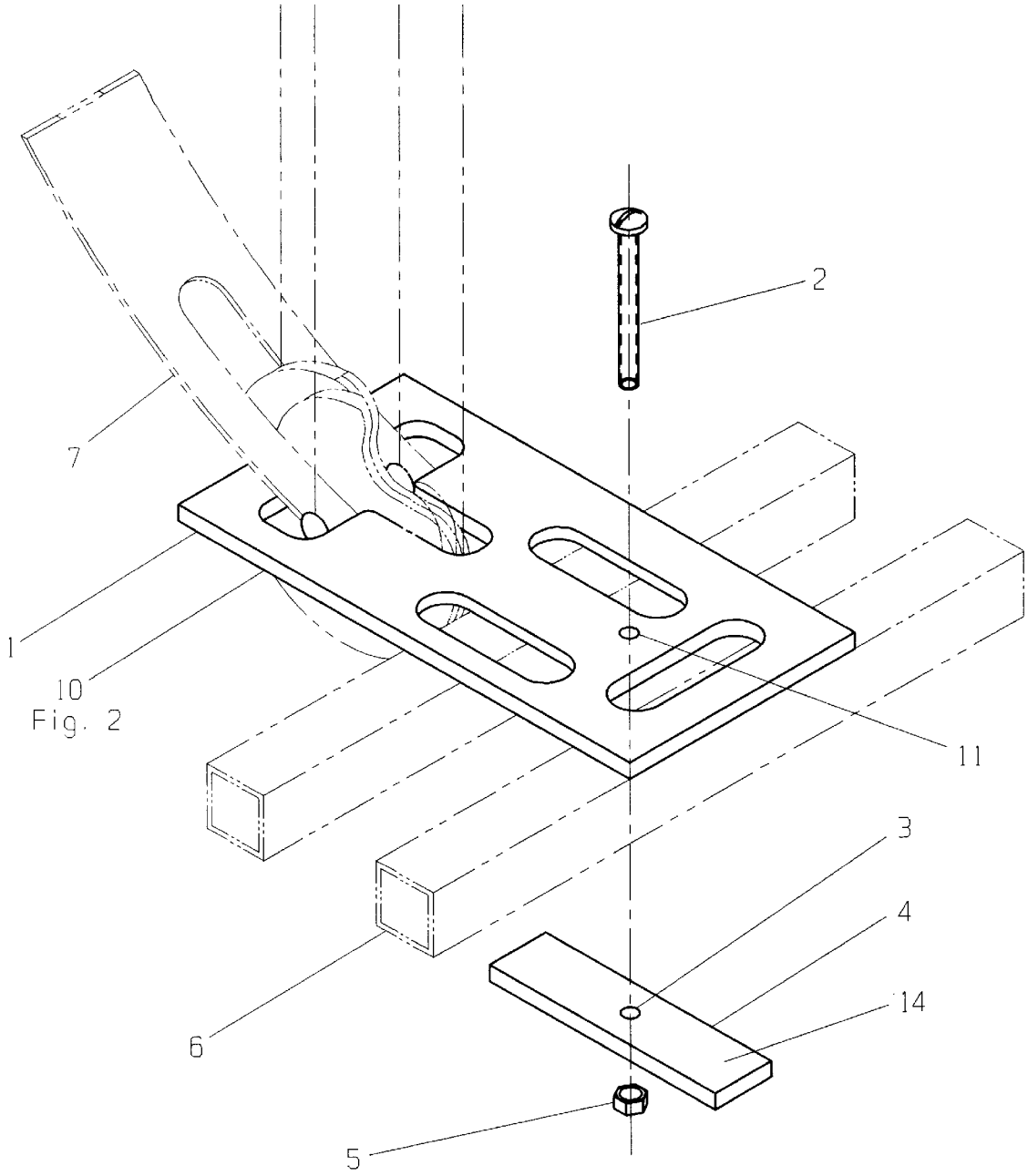
FIG. 1 shows the preferred embodiment of the present invention holding a bow as it would be installed on a prior art tree stand.

As shown in FIG. 1, the preferred embodiment of the present invention, a bow holder 1 suitable for attaching to a treestand 6 comprising a plate 10, a clamp bar 4 and a means of attaching said bow holder 1 to the treestand 6, said means of attaching said bow holder 1 to the treestand 6 comprising a bolt screw 2 and a hex locknut 5 in the preferred embodiment of the present invention. The bow holder 1 is shown in FIG. 1 holding a prior art compound bow 7. The bow holder 1 is mounted on a prior art treestand 6. The clamp bar 4 includes a mounting aperture 3 and a coating 14.

Figure 2:
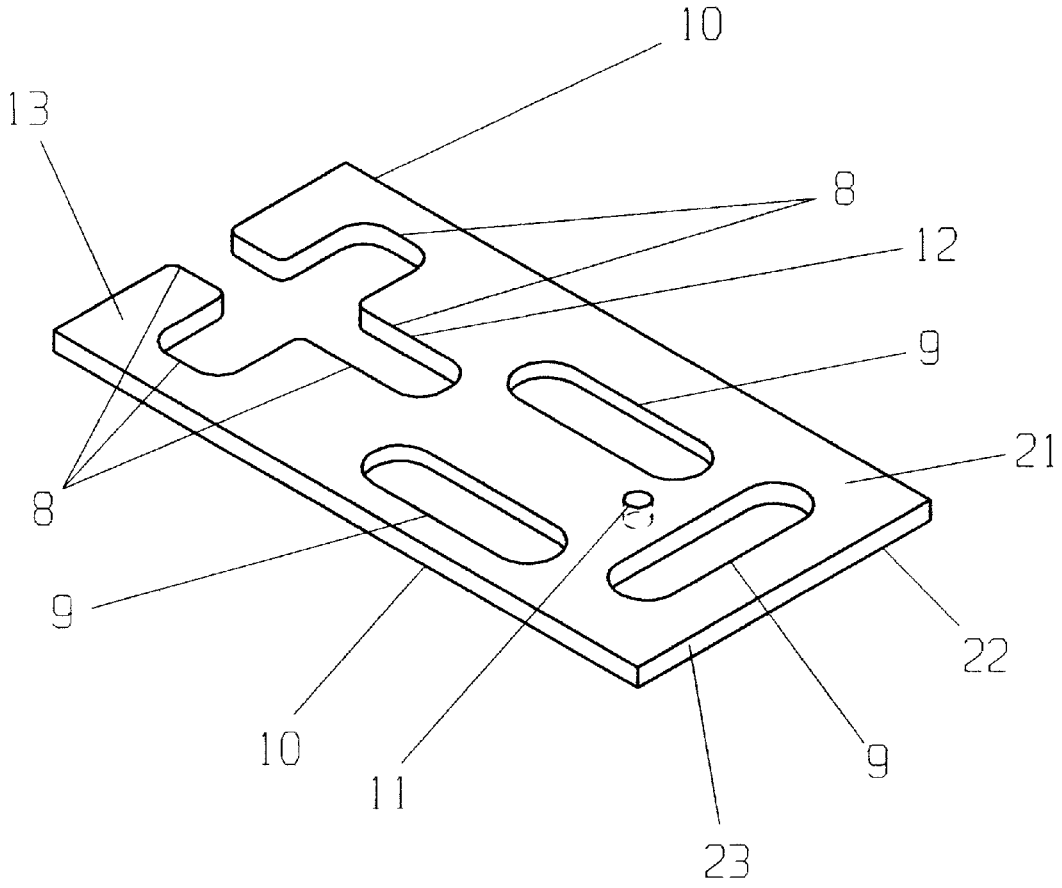
FIG. 2 illustrates a support plate.

FIG. 2 shows the plate 10 which, in the preferred embodiment of the present invention includes a cross-shaped aperture 12, oblong apertures 9, a fastener clearance 11, a top surface 21, a bottom surface 22, and an outer edge 23, and a vinyl coating 13. The cross-shaped aperture 12 includes four lobes 8, one of which extends through said outer edge 23. The oblong apertures 9, in the preferred embodiment of the present invention, have parallel sides connected by semicircular arcs as shown in FIG. 2. In the preferred embodiment of the present invention, the plate 10 would be of structural aluminum such as a 6061 alloy, with the vinyl coating 13 being a dull finish. Aluminum is desirable to save weight. A 6061 or similar grade alloy is desirable for strength. The vinyl coating 13 is desirable to prevent damage to the bow. The oblong apertures 9 are desirable as they reduce vibrations resulting from dragging the bow 7 against the vinyl coating 13 of the plate 10 when removing the bow from the bow holder 1. Without the oblong apertures 9, there is a "violin effect" which results in audible noise which is unacceptable to deer hunters. Two parallel and one transverse oblong apertures 9 are a best mode embodiment of the present invention on a bow holder 1 for a treestand 6. The dull finish is preferred as being less noticeable, attractive to people who might buy the bow holder 1, and less apt to reflect light which might be noticed by quarry such as deer. The clamp bar 4, in the preferred embodiment of the present invention would be a structural grade aluminum, such as 6061 alloy, with a dull black coating 14. The best mode to date of the coating 14 is a powder coating.

Figure 3:
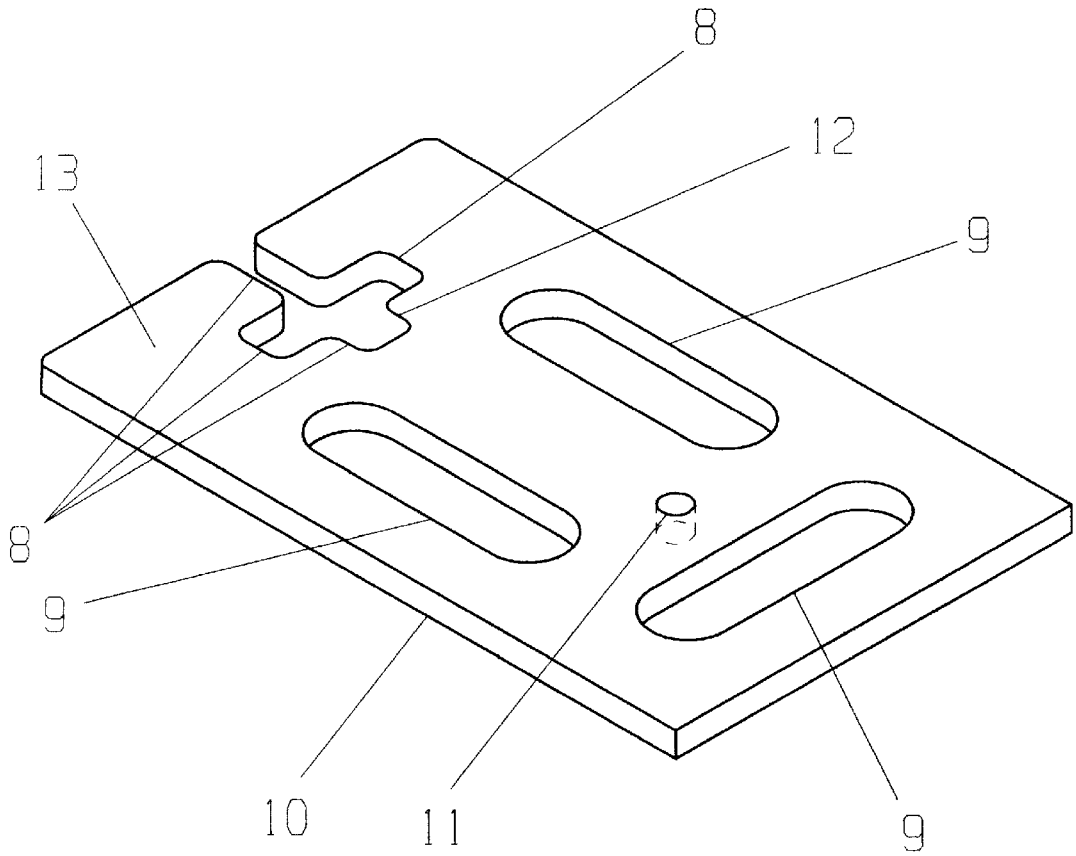
FIG. 3 illustrates an alternate embodiment of the support plate from FIG. 2.

FIG. 3 illustrates the plate 10 with the cross-shaped apereture 12 with the lobes 8 visibly shorter than shown in FIG. 2. The length of the bow cam and pulley slot 12 can vary, depending on what is required for a given bow 7.

Referring to FIGS. 1 and 2, the bow holder 1 is attached to the treestand 6 by means of the bolt 2 through the fastener clearance 11 of the plate 10, which is on the treestand 6, and the mounting aperture 3 of the clamp bar 4, which is under the treestand 6, and the hex locknut 5, said locking hexnut 5 installed on the bolt 2 as required to clamped the bow holder 1 around the treestand 2. By attaching the bow holder 1 to the treestand 6 directly in front of a deer hunder, the deer hunter can remove a bow 7 with a minimum of movement. The deer hunter merely pulls the bow 7 towards him or her self, so that the bow pivots about the plate 10, and then the bow 7 is lifted out of the bow holder 1 as part of aiming an arrow at a quarry. Note that the bow 7 is resting in the cross aperture 12. The plate 10 against underside of the bow 7 acts as a pivot, about which the end of the bow 7 tends to rotate, except the end of the bow 7 is held against the underside of the plate 10. The bow 7 is held in place by its own weight, yet is easy to remove from the bow holder 1.

Figure 4:
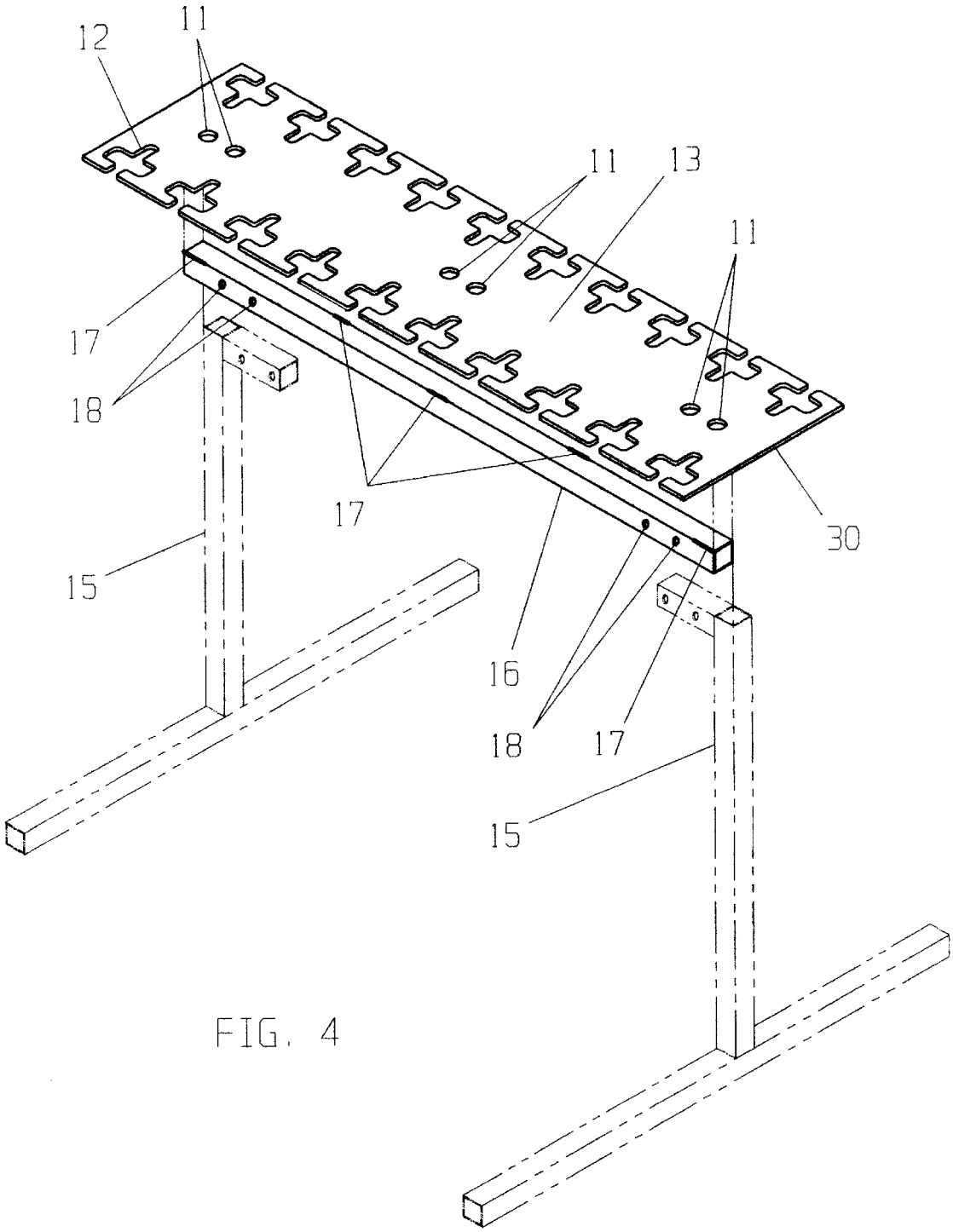
FIG. 4 illustrates an embodiment of the present invention suitable for storing or displaying multiple bows.

FIG. 4 illustrates an alternate embodiment of the present invention, a multiple bow holder storage plate 30 which comprises the cross apertures 12, fastener clearances 11, and the vinyl coating 13. The storage plate 30 can be attached to a bar 16 which facilitates attachement to supports 15 and used to store or display multiple bows. Typically the bar 16 would be welded to the multiple bow holder storage plate 30 by weldments in locations 17 as indicated on the bar 16 in FIG. 4. Then the multiple bow holder storage plate 30 with the bar 16 would be vinyl coated with vinyl coating 13. Then the bar 16 could be attached to the supports 15. A means of attachment would be by bolts secured by nuts, utilizing bolt clearances such as bolt clearances 18 shown as a part of the bar 18 in FIG. 4. Or as an alternate means of support of the storage plate 30, the storage plate 30 can be attached to an appropriately supported 2×4 piece of wood using fasteners through the fastener clearances 11.

Although the description above contains many specificities, these should not be construed as limiting the scope of the invention but as merely providing illustrations of some of the presently preferred embodiments of this invention. For example, a slotted head screw 2 with a hex locknut 5 is used as a means of fastening the bow holder 1 to the tree stand. A person could use a slotted head screw 2 into a clamp bar 4 with a threaded aperture to receive the slotted head screw 2. Or, one could use an ordinary nut with a lockwasher. The intent is to use a fastening means to clamp the plate 10 and the clamp bar 4 around a portion of the tree stand so that the bow holder 1 is secured, or clamped, in position.

Thus the scope of the invention should be determined by the appended claims and their legal equivalents, rather than by the examples given.

I claim:

1. A bow holder, comprising:

a) a plate, including top and bottom surfaces and an outer edge, said plate defining a cross-shaped aperture extending through said top and bottom surfaces, said cross-shaped aperture including four lobes, wherein one of the lobes also extends through said outer edge, b) a fastener clearance through said plate extending through said top and bottom surfaces;

c) a clamp bar defining a mounting aperture; and d) a bolt sized to extend through the fastener clearance and the mounting aperture for clamping the plate and clamp bar together.

2. The bow holder of claim 1 further comprising a plurality of oblong apertures through said plate extending through said top and bottom surfaces.

* * * * *